United States Patent [19]

Steff de Verninac

[11] Patent Number: 4,844,549

[45] Date of Patent: Jul. 4, 1989

[54] MILLING MACHINE FOR DIGGING TRENCHES IN THE EARTH

[75] Inventor: Bertrand Steff de Verninac, Pont a Marco, France

[73] Assignee: Soletanche, Nanterre, France

[21] Appl. No.: 219,586

[22] Filed: Jul. 15, 1988

[30] Foreign Application Priority Data

Jul. 16, 1987 [FR] France ..... 87 10069

[51] Int. Cl.[4] ..... E02F 5/08

[52] U.S. Cl. ..... 175/91; 37/94; 175/96

[58] Field of Search ..... 175/91, 95, 96; 299/59, 299/60; 37/91, 94, DIG. 6

[56] References Cited

U.S. PATENT DOCUMENTS

| | | | |
|---|---|---|---|
| 3,894,587 | 7/1975 | Sourice | 175/91 |
| 4,391,472 | 7/1983 | Krekler | 175/91 |
| 4,800,967 | 1/1989 | Chagnot et al. | 175/96 |

FOREIGN PATENT DOCUMENTS

| | | |
|---|---|---|
| 207232 | 1/1987 | . |
| 1545629 | 10/1968 | France . |
| 2578876 | 9/1986 | France . |

*Primary Examiner*—Jerome W. Massie, IV
*Assistant Examiner*—David J. Bagnell
*Attorney, Agent, or Firm*—Schweitzer & Cornman

[57] ABSTRACT

A milling machine for digging trenches in the earth, of the type comprising at least one substantially vertical support plate on both sides of which two milling drums are mounted for rotation about an axis substantially perpendicular to the plate, each of the drums carrying, on the one of its edges which is adjacent to the support plate, at least one tool which projects laterally with respect to this edge, and the support plate including opposite the trajectory of said tools, circular channels coaxial with the drums, through which the ends of these tools pass when the drums turn. The projecting tools of one of the drums redisposed at a distance from the axis which is different from the distance to the axis from the projecting tools of the other drum, the channels having, correspondingly, different radii.

5 Claims, 2 Drawing Sheets

MILLING MACHINE FOR DIGGING TRENCHES IN THE EARTH

BACKGROUND AND SUMMARY OF THE INVENTION

The present invention concerns a milling machine for digging trenches in the earth, and more particularly to such a machine of the type comprising at least one substantially vertical support plate, on both sides of which two milling drums are mounted for rotation about an axis substantially perpendicular to the plate.

Already known are such milling machines, generally comprising two plates, which accordingly support four drums, turning two-by-two in opposite directions so as to return the milling debris toward an aspiration intake located at the axis of the machine.

To the extent that such machines are being built with greater and greater capacity, it has been necessary to increase the thickness of the support plate, which must absorb the forces exerted by the earth on the milling drums.

This thickness of the support plate creates difficulties when digging a trench. Indeed, the milling tools mounted on the two drums alongside the support plate must be sufficiently spaced apart from each other to permit the passage of this plate when the drums rotate. The result is the formation of a ridge at the bottom of the trench, whose width is generally at least equal to that of the plate.

When the milling machine descends, the lower edge of the support plate comes against this ridge, and thus can interfere with the progress of the digging.

Various solutions have already been proposed to this problem. Thus, it has been proposed to mount the milling tools alongside the plate movably on the drums, so that the tools of the two drums come close to one another when they are in a position clear of the support plate. However, this solution has proved to be delicate to carry out, to the extent that the axes of articulation of these tools must bear extremely substantial forces.

Another solution was proposed in the document FR-A No. 2 252 011. This solution consists of mounting, on the edge adjacent to the support plate of each of the drums, at least one tool that projects laterally with respect to this edge, the support plate comprising, opposite the trajectory of these tools, circular channels coaxial with the drums in which the ends of these tools pass when the drums turn.

The milling tools are thus mounted fixed on the drums, but the tools that are projecting are able to be spaced apart by a distance less than the thickness of the plate.

This solution has proved to be satisfactory. However, with the thicknesses of the plate now being utilized, the ridge still has a sufficient dimension to resist the weight of the milling machine exerted by means of the lower surfaces of the edge of the support plate.

The object of the present invention is to reduce these difficulties.

For this purpose, the object of the invention is a milling machine for digging trenches in the earth, of the type comprising at least one substantially vertical support plate on both sides of which two milling drums are mounted for rotation about an axis substantially perpendicular to the plate, each of the drums carrying, on that one of its edges that is adjacent to the support plate, at least one tool which projects laterally with respect to this edge, and the support plate comprising, opposite the trajectory of said tools, circular channels coaxial with the drums, in which the ends of these tools pass when the drums turn, characterized by the fact that the projecting tools of one of the drums are disposed at a distance from said axis that is different from the distance to said axis from the tools projecting from the other drum, said channels accordingly having different radii.

The invention therefore allows the ridge to be totally eliminated. Indeed, for this it is sufficient for the bottoms of the two channels to be substantially in the same plane. In fact, it is even possible, by offsetting these planes to make the trajectories of the projecting tools overlap.

The channels can be machined in the support plate, but preferably the support plate is made of cast steel.

In this case, the support plate can present substantially an S shape, when seen in cross-section according to a plane passing through the axis of the drums.

It is also possible, by producing a cast support plate, to easily provide it with fluid intake conduits for the drive motors of the drums, if these latter are disposed in the interior of the drums themselves.

One particular mode of carrying out the invention will now be described, by way of example, with reference to the accompanying schematic drawings, in which:

DETAILED DESCRIPTION OF INVENTION

Figure 1:
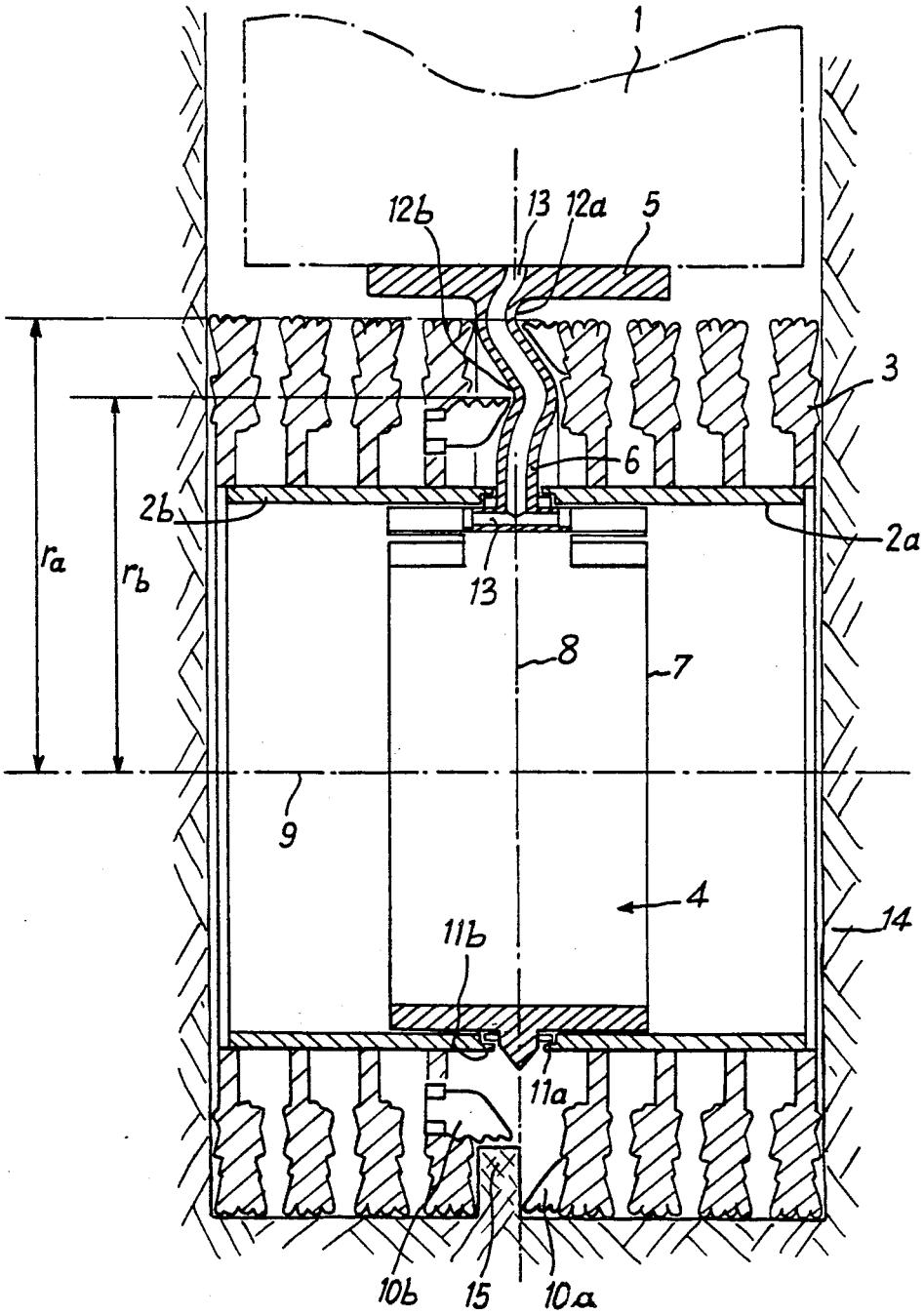
FIG. 1 is an axial, vertical cross-sectional view of the cutters of the machine and their mounting device.

The milling machine shown in FIG. 1 comprises a frame 1 at the lower part of which are mounted milling drums 2*a* and 2*b* provided at their periphery with milling tools 3.

Figure 2:
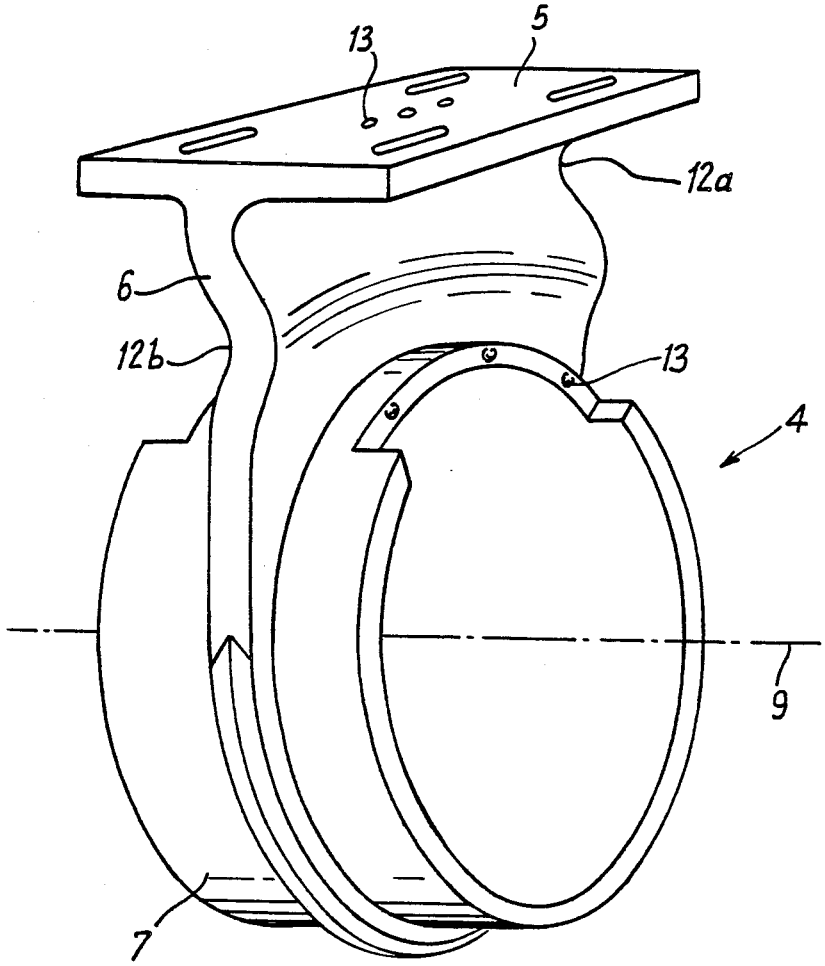
FIG. 2 is a perspective view of this device.

The drums 2*a* and 2*b* are mounted on the frame 1 by means of a support device 4 shown in perspective in FIG. 2.

This support device comprises essentially a mounting shoe 5, a support plate 6, and a mounting shell 7.

The mid-plane 8 of the support plate 6 is substantially vertical in operation, the axis 9 of the shell being perpendicular to this plane. The milling drums 2*a* and 2*b* are also centered on this axis 9. Hydraulic motors (not shown) are mounted in the interior of the shell 7 for driving the drums.

The drum 2*a* comprises, alongside the plane 8, tools 10*a* which project laterally from its edge 11*a*, while the drum 2*b* comprises, also alongside the plane 8, tools 10*b* which project laterally from its edge 11*b*.

The radially outward edges of the tools 10*a* are located at a distance $r_a$ from the axis 9, while the radially outward edges of the tools 10*b* are located at a distance $r_b$, which is less than $r_a$, from this same axis.

The tools 10*a* and 10*b* project laterally from the edges of their respective drum by such a distance that they extend practically to the plane 8.

In order to permit the passage of these tools 10*a* and 10*b* at the upper portion of the device 4, the plate 6 comprises two circular channels 12*a* and 12*b* centered on the axis 9. The bottoms of the channels 12*a* and 12*b* are located substantially in the plane 8, their radii being respectively equal to $r_a$ and $r_b$.

Thus, when the drums 2*a* and 2*b* rotate, the laterally projecting ends of the tools 10*a* pass through the channel 12*a* and the ends of the tools 10*b* pass through the channel 12*b*.

The support plate 6 in the present case is made of cast steel. The channels 12*a* and 12*b* accordingly result from the casting of the plate, such that the plate presents, in axial cross-section, as seen in FIG. 1, substantially the shape of an S.

Moreover, the plate 6, in the present case, is provided with conduits 13 permitting hydraulic fluid to be conducted to the drive motor of the milling drums.

FIG. 1 shows the milling machine according to the invention disposed in a trench 14. As seen therein, in the lower part of the trench the tools 10*a* leave behind only a half-ridge 15, which is itself eliminated by the tools 10*b*.

Different variations and modifications can, of course, be applied to the preceding description, still within the spirit and scope of the invention.

I claim:

1. A milling machine for digging trenches in the earth, of the type comprising at least one substantially vertical support plate on both sides of which two milling drums are mounted for rotation about an axis substantially perpendicular to the plate, each of the drums carrying on the one of its edges which is adjacent to the support plate at least one tool which projects laterally with respect to this edge, and the support plate including, opposite the trajectory of said tool on each drum, circular channels coaxial with the drums, in which the ends of at least one tool on each drum pass when the drums turn, the at least one projecting tool of one drum being disposed at a first distance from said axis, the at least one projecting tool of the other drum being disposed at a second different distance from said axis, said channels having radii corresponding to said different distances.

2. A milling machine according to claim 1 corresponding to said different distances, wherein the bottoms of the two channels are substantially in the same plane.

3. A milling machine according to claim 1, wherein said support plate is made of cast steel.

4. A milling machine according to claim 1, wherein said support plate presents, as seen in crosssection in a plane passing through the axis of the drums, substantially the shape of an S.

5. A milling machine according to claim 1, wherein said support plate comprises conduits for supplying fluid.

* * * * *